US009536402B2

(12) United States Patent
Ogishi

(10) Patent No.: US 9,536,402 B2
(45) Date of Patent: Jan. 3, 2017

(54) ELECTRONIC DEVICE THAT OUTPUTS EASILY RECOGNIZABLE NOTIFICATION SOUND AND RECORDING MEDIUM

(71) Applicant: Kyocera Document Solutions Inc., Osaka (JP)

(72) Inventor: Ryosuke Ogishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/751,168

(22) Filed: Jun. 26, 2015

(65) Prior Publication Data

US 2015/0379835 A1 Dec. 31, 2015

(30) Foreign Application Priority Data

Jun. 26, 2014 (JP) ..... 2014-131546

(51) Int. Cl.
*G08B 3/10* (2006.01)

(52) U.S. Cl.
CPC ..... *G08B 3/10* (2013.01)

(58) Field of Classification Search
CPC ..... G08B 3/10
USPC ..... 340/384.71
See application file for complete search history.

(56) References Cited

U.S. PATENT DOCUMENTS

2012/0114144 A1* 5/2012 Hakoda ..... G10L 21/06 381/107
2012/0299717 A1* 11/2012 Yoshino ..... B60Q 9/00 340/466

FOREIGN PATENT DOCUMENTS

JP S59-044680 A 3/1984
JP H05-048804 A 2/1993
JP 2005-134971 A 5/2005

* cited by examiner

*Primary Examiner* — Dhaval Patel
(74) *Attorney, Agent, or Firm* — James Judge

(57) ABSTRACT

An electronic device includes a sound output circuit, a notification sound control circuit, and a stop instruction accepting circuit. The sound output circuit outputs a sound. The notification sound control circuit controls a notification sound output by the sound output circuit. The stop instruction accepting circuit accepts a stop instruction of the notification sound. The notification sound control circuit increases frequency of the notification sound in phases as time elapses when the notification sound is output by the sound output circuit, and stops the notification sound output by the sound output circuit when the instruction is accepted by the stop instruction accepting circuit.

9 Claims, 4 Drawing Sheets

FIG. 2

18b

| Age | Less than 50 years old | Equal to or more than 50 years old and less than 60 years old | Equal to or more than 60 years old and less than 70 years old | Equal to or more than 70 years old and less than 75 years old | Equal to or more than 75 years old and less than 80 years old | Equal to or more than 80 years old |
|---|---|---|---|---|---|---|
| Upper limit of frequency | 8000Hz | 4000Hz | 2000Hz | 1500Hz | 500Hz | 100Hz |

ELECTRONIC DEVICE THAT OUTPUTS EASILY RECOGNIZABLE NOTIFICATION SOUND AND RECORDING MEDIUM

INCORPORATION BY REFERENCE

This application is based upon, and claims the benefit of priority from, corresponding Japanese Patent Application No. 2014-131546 filed in the Japan Patent Office on Jun. 26, 2014, the entire contents of which are incorporated herein by reference.

BACKGROUND

Unless otherwise indicated herein, the description in this section is not prior art to the claims in this application and is not admitted to be prior art by inclusion in this section.

There is known an electronic device that outputs notification sound at the frequency corresponding to a target's age of the notification sound as a typical electronic device.

SUMMARY

An electronic device according to an aspect of the disclosure includes a sound output circuit, a notification sound control circuit, and a stop instruction accepting circuit. The sound output circuit outputs a sound. The notification sound control circuit controls a notification sound output by the sound output circuit. The stop instruction accepting circuit accepts a stop instruction of the notification sound. The notification sound control circuit increases frequency of the notification sound in phases as time elapses when the notification sound is output by the sound output circuit, and stops the notification sound output by the sound output circuit when the instruction is accepted by the stop instruction accepting circuit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 2 illustrates an exemplary table according to the embodiment.

DETAILED DESCRIPTION

Figure 1:
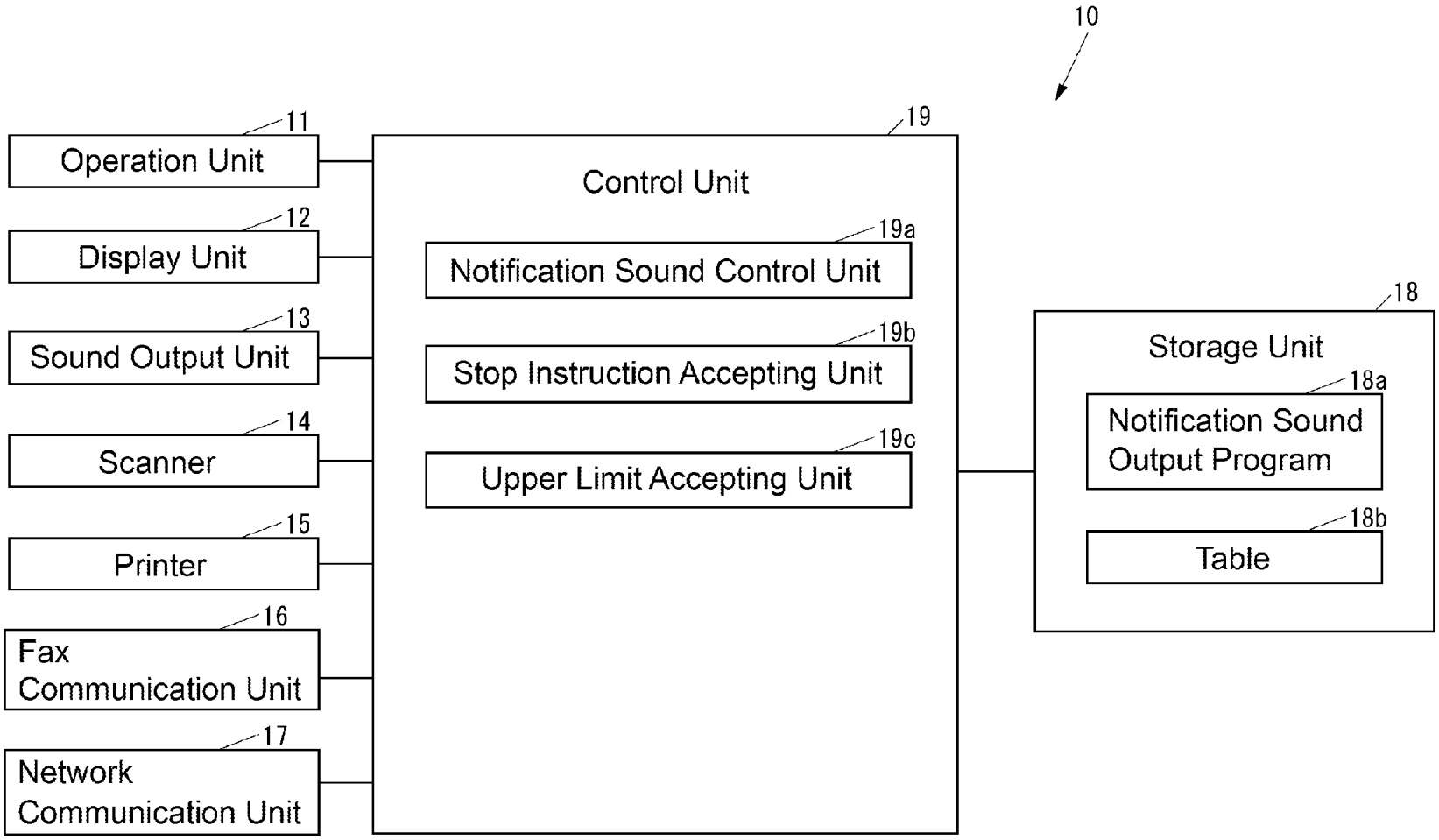
FIG. 1 illustrates an MFP according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure with reference to the drawings.

First, the following describes a configuration of a multifunction peripheral (MFP) as an electronic device according to the embodiment.

FIG. 1 illustrates an MFP 10 according to the embodiment.

As illustrated in FIG. 1, the MFP 10 includes an operation unit 11, a display unit 12, a sound output unit 13, a scanner 14, a printer 15, a fax communication unit 16, a network communication unit 17, a storage unit 18, and a control unit 19. The operation unit 11 is an input device such as a button for receiving various kinds of operations. The display unit 12 is a display device such as a liquid crystal display (LCD) that displays various kinds of information. The sound output unit 13 is a sound output device such as a chime, a buzzer, a bell and a speaker that output sound. The scanner 14 is a reading device that reads image data from an original document. The printer 15 is a print device that executes a print job on a recording medium such as a paper sheet. The fax communication unit 16 is a fax device that performs a fax communication with an external facsimile device (not illustrated) via a communication line such as a dial-up line. The network communication unit 17 is a network communication device that communicates with an external device via a network such as a local area network (LAN) and the internet. The storage unit 18 is a storage device such as an electrically erasable programmable read only memory (EEPROM) and hard disk drive (HDD) that store various kinds of data. The control unit 19 controls the entire MFP 10.

The storage unit 18 stores a notification sound output program 18*a* for causing the sound output unit 13 to output a notification sound. The notification sound output program 18*a* may be installed on the MFP 10 at production stage of the MFP 10, additionally installed on the MFP 10 from a storage medium such as an SD card, a universal serial bus (USB) memory, or additionally installed on the MFP 10 via a network.

The storage unit 18 can store a table 18*b* indicating a relationship between: ages of the MFP 10 users, who are targets of the notification sound; and upper limits of the notification sound frequency.

FIG. 2 illustrates an example of the table 18*b*.

The table 18*b* illustrated in FIG. 2 indicates that target's ages of the notification sound of "less than 50 years old," "equal to or more than 50 years old and less than 60 years old," "equal to or more than 60 years old and less than 70 years old," "equal to or more than 70 years old and less than 75 years old," "equal to or more than 75 years old and less than 80 years old," and "equal to or more than 80 years old" have corresponding upper limits of 8000 Hz, 4000 Hz, 2000 Hz, 1500 Hz, 500 Hz, and 100 Hz, respectively.

The control unit 19 illustrated in FIG. 1 is a circuit that includes, for example, a central processing unit (CPU), a read only memory (ROM), which stores programs and various kinds of data, and a random access memory (RAM), which is used as a work area of the CPU. The CPU executes the program stored in the ROM or the storage unit 18, which is non-transitory computer-readable.

Executing the notification sound output program 18*a* stored in the storage unit 18 causes the control unit 19 to function as a notification sound control unit 19*a*, a stop instruction accepting unit 19*b*, and an upper limit accepting unit 19*c*. The notification sound control unit 19*a* is a circuit that controls the notification sound output by the sound output unit 13. The stop instruction accepting unit 19*b* is a circuit that accepts an instruction to stop the notification sound. The upper limit accepting unit 19*c* is a circuit that accepts the upper limit specification of the notification sound frequency.

Next, the following describes an operation of the MFP 10.

The upper limit accepting unit 19*c* accepts the specifications of ages of the MFP 10 users, who are targets of the notification sound via the operation unit 11 or via the network communication unit 17 from an external device of the MFP 10, so as to accept the upper limits corresponding to the ages illustrated in the table 18*b*. For example, when the upper limit accepting unit 19*c* accepts that the age of the MFP 10 user is equal to or more than 60 years old and less than 70 years old, the upper limit accepting unit 19*c* accepts the upper limit of the notification sound frequency of 2000 Hz based on the table 18*b*.

Figure 3:
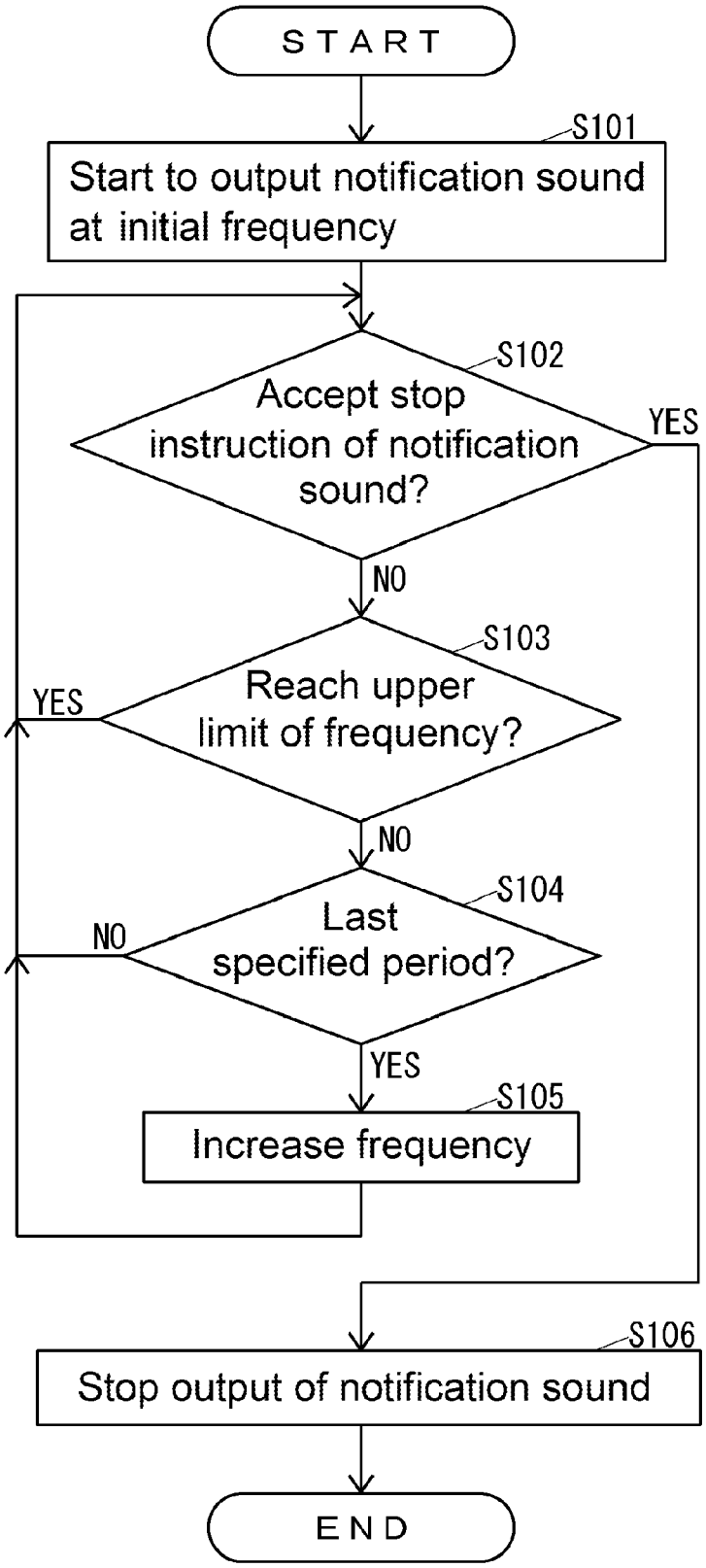
FIG. 3 illustrates an operation of the MFP according to the embodiment when outputting a notification sound.

When it is necessary to call the user's attention in case of a jam of the recording medium or a similar situation in the printer 15, the control unit 19 executes the operation illustrated in FIG. 3.

FIG. 3 illustrates the operation of the MFP 10 when outputting the notification sound.

As illustrated in FIG. 3, the notification sound control unit 19*a* causes the sound output unit 13 to start outputting the notification sound at initial frequency $f_{min}$, which is lower than the upper limit $f_{max}$ accepted by the upper limit accepting unit 19*c* (Step S101).

Next, the stop instruction accepting unit 19*b* determines whether or not the stop instruction accepting unit 19*b* accepts the stop instruction of the notification sound (Step S102). Here, the stop instruction accepting unit 19*b* can accept the stop instruction of the notification sound via the operation unit 11 or via the network communication unit 17 from the external device of the MFP 10. Additionally, when the notification sound is output for an error such as a jam of recording medium in the printer 15, the stop instruction accepting unit 19*b* can accept its error elimination as the stop instruction of the notification sound.

When the stop instruction accepting unit 19*b* determines that the stop instruction accepting unit 19*b* has not accepted the stop instruction of the notification sound at Step S102, the notification sound control unit 19*a* determines whether or not the current frequency of the notification sound reaches the upper limit $f_{max}$ accepted by the upper limit accepting unit 19*c* (Step S103).

When the notification sound control unit 19*a* determines that the current frequency of the notification sound does not reach the upper limit $f_{max}$ at Step S103, the notification sound control unit 19*a* determines whether or not an output duration of the notification sound at the current frequency has reached the specified period ΔT (Step S104). The period ΔT may be set to any duration. For example, the period ΔT may be a period from one second to five seconds.

When the notification sound control unit 19*a* determines that the output duration of the notification sound at the current frequency reaches the specified period ΔT at Step S104, the notification sound control unit 19*a* increases the notification sound frequency by the specified increment amount Δf (Step S105).

When the notification sound control unit 19*a* determines that the current frequency of the notification sound reaches the upper limit $f_{max}$ at Step S103, or the output duration of the notification sound at the current frequency does not reach the specified period ΔT at Step S104, or the notification sound control unit 19*a* terminates the process of Step S105, the stop instruction accepting unit 19*b* executes the process of Step S102.

When the stop instruction accepting unit 19*b* determines that the stop instruction accepting unit 19*b* accepts the stop instruction of the notification sound at Step S102, the notification sound control unit 19*a* stops the notification sound output by the sound output unit 13 (Step S106), and then terminates the operation illustrated in FIG. 3.

Figure 4:
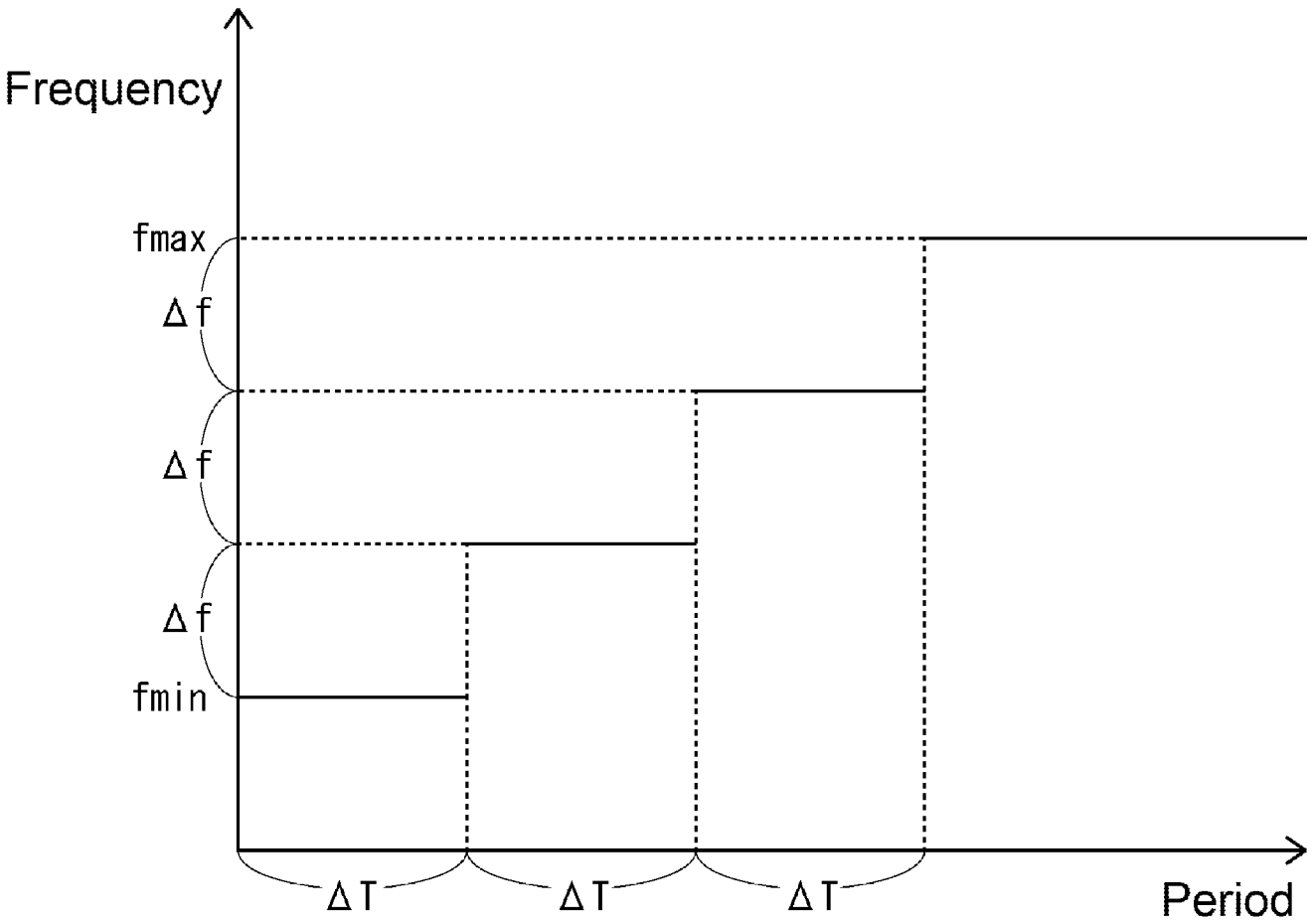
FIG. 4 illustrates an exemplary variation in frequency of notification sound output by the operation illustrated in FIG. 3.

FIG. 4 illustrates an exemplary variation in frequency of the notification sound output by the operation illustrated in FIG. 3.

In the operation illustrated in FIG. 3, the notification sound control unit 19*a* increases the notification sound frequency output by the sound output unit 13 in increments of Δf in phases, as time elapses, to the upper limit $f_{max}$ accepted by the upper limit accepting unit 19*c* as illustrated in FIG. 4 until the stop instruction accepting unit 19*b* accepts the stop instruction of the notification sound in the operation. Then, after the notification sound frequency reaches the upper limit $f_{max}$ accept by the upper limit accepting unit 19*c*, the notification sound control unit 19*a* maintains the notification sound frequency output by the sound output unit 13 at the upper limit $f_{max}$ accepted by the upper limit accepting unit 19*c* until the stop instruction accepting unit 19*b* accepts the stop instruction of the notification sound.

When the upper limit $f_{max}$ is changed by acceptance of the upper limit $f_{max}$ at the upper limit accepting unit 19*c*, the notification sound control unit 19*a* may change at least one of the initial frequency $f_{min}$ and the increment amount Δf of frequency. For example, when the upper limit $f_{max}$ is changed by acceptance of the upper limit $f_{max}$ by the upper limit accepting unit 19*c*, the notification sound control unit 19*a* may set a value obtained by subtracting the initial frequency $f_{min}$ from the upper limit $f_{max}$ and then dividing it by a count of the phases of frequency change as the increment amount Δf, without changing the initial frequency $f_{min}$. When the upper limit $f_{max}$ is changed by acceptance of the upper limit $f_{max}$ by the upper limit accepting unit 19*c*, the notification sound control unit 19*a* may change the initial frequency $f_{min}$ without any change of the increment amount Δf and the count of the phases of frequency change. Additionally, when the upper limit $f_{max}$ is changed by acceptance of the upper limit $f_{max}$ by the upper limit accepting unit 19*c*, the notification sound control unit 19*a* may change the count of the phases of frequency change without any change of the initial frequency $f_{min}$ or the increment amount Δf.

As described above, when the notification sound is output, the MFP 10 increases the notification sound frequency in phases as time elapses (Yes at Step S104, and Step S105). Since it is uncomfortable for a user to hear high-frequency sound, the user easily recognizes the sound. Namely, while the MFP 10 outputs the notification sound, the MFP 10 gradually changes the notification sound to easily-recognizable notification sound. That is, the MFP 10 ensures facilitated recognition of the notification sound.

The MFP 10 changes the notification sound frequency without any variation of volume level of the notification sound. That ensures the reduced inconvenience due to the notification sound to a person who is around the MFP 10 and other than the target of the notification sound when any person who is other than an MFP 10 user, that is, the target of the notification sound is around the MFP 10, compared with a configuration of changing the volume level of the notification sound.

The MFP 10 may change not only the notification sound frequency but also the volume level of the notification sound.

In the configuration of increasing the notification sound frequency in phases as time elapses for outputting the notification sound (Yes at Step S104 and Step S105), the MFP 10 stops the output notification sound in response to an instruction (Yes at Step S102 and Step S106). This causes a stop of the output notification sound soon, thus ensuring the reduced inconvenience due to high-frequency-notification sound to the target.

The MFP 10 accepts the upper limit specification of the notification sound frequency simply by specifying the target's age. This ensures the facilitated upper limit specification of the notification sound frequency.

The MFP 10 is not limited to accept the upper limit of the notification sound by accepting the specification of the target's age, and may be directly specified by accepting the upper limit of the notification sound frequency.

The MFP 10 is specified to have the upper limit of the notification sound frequency. That ensures that the MFP 10 outputs the appropriate notification sound correspond to the target by specifying the appropriate upper limit according to the target's various circumstances such as upper limit deterioration of an audible range due to the target's aging.

In FIG. 4, the time periods at the respective frequency phases until the frequency reaches the upper limit $f_{max}$ each have a certain interval, namely $\Delta T$ in a series of the frequency change in the embodiment. However, the time periods at the respective frequency phases until the frequency reaches the upper limit $f_{max}$ may be varied in the series of the frequency change. For example, the notification sound control unit may shorten the duration of the notification sound corresponding to the frequency each time the frequency of the notification sound increases in phases. In this example, in the series of the frequency change, the time periods at the respective frequency phases are gradually shortened. That is, the low-frequency-notification sound is output for a long period. This causes the notification sound to be recognized easily at the phase of low frequency compared with the configuration having the constant time periods at the respective frequency phases. Thus, this increases the possibility to stop the notification sound before the high-frequency-notification sound is output. Additionally, as the elapsed time lengthens, the intervals of the notification sound frequency variation become short. This causes the notification sound to be recognized easily at the phase when the intervals of the notification sound frequency variation become short, namely at the phases of high frequency, compared with the configuration having the constant time periods at the respective frequency phases even when the notification sound is not recognized at the phase of low frequency. For example, the notification sound control unit may lengthen the duration of the notification sound corresponding to the frequency each time the frequency of the notification sound increases in phases. In this example, in the series of the frequency change, the time periods at the respective frequency phases may be gradually lengthened. That is, the frequencies relative to the period since the notification sound starts outputting transitions relatively high even when the time period immediately after the notification sound starts outputting is short, compared with the configuration having the constant time periods at the respective frequency phases. This causes the notification sound to be recognized easily at the earlier phase after the notification sound starts outputting, compared with the configuration having the constant time periods at the respective frequency phases.

In FIG. 4, the increment amounts between the respective frequency phases while the frequency reaches the upper limit $f_{max}$ have a constant amount, namely $\Delta f$ in the series of the frequency change in the embodiment. However, the increment amounts between the respective frequency phases while the frequency reaches the upper limit $f_{max}$ may be varied in the series of the frequency change. For example, the notification sound control circuit may increase the increment amount of the frequency each time the frequency of the notification sound increases in phases. In this example, in the series of the frequency change, the increment amounts between the respective frequency phases are gradually increased. That is, as the elapsed time lengthens, the increment amounts of the notification sound frequency increase. This causes the notification sound to be recognized easily at the phase when the increment amounts of the frequency have increased, namely at the phase of high frequency, even when the notification sound is not recognized at the phase of low frequency. For example, the notification sound control circuit may decrease the increment amount of the frequency each time the frequency of the notification sound increases in phases. In this example, in the series of the frequency change, the increment amounts between the respective frequency phases may be gradually decreased. That is, when the increment amounts immediately after the notification sound starts outputting are large after the notification sound starts outputting, the notification sound frequency transitions to high frequency at the early phase compared with the configuration having the constant time periods at the respective frequency phases. This causes the notification sound to be recognized easily at the earlier phase after the notification sound starts outputting compared with the configuration having the constant time periods at the respective frequency phases.

While in the embodiment the electronic device of the disclosure is an MFP, the electronic device may be an image forming apparatus other than the MFP, such as a printer-only machine, a copy-only machine, a FAX-only machine, or may be an electronic device other than the image forming apparatus such as a personal computer (PC), insofar as an electronic device includes a sound output unit.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An electronic device comprising:

a sound output circuit that outputs a sound;

a notification sound control circuit that controls a notification sound output by the sound output circuit;

an upper limit accepting circuit that accepts an upper limit specification of the frequency of the notification sound; and a stop instruction accepting circuit that accepts a stop instruction of the notification sound; wherein the notification sound control circuit increases frequency of the notification sound in phases as time elapses when the notification sound is output by the sound output circuit, and stops the notification sound output by the sound output circuit when the instruction is accepted by the stop instruction accepting circuit, and the notification sound control circuit increases the frequency of the notification sound to the upper limit accepted by the upper limit accepting circuit in phases as time elapses when the notification sound is output by the sound output circuit.

2. The electronic device according to claim 1, wherein the upper limit accepting circuit accepts a specification of a target's age of the notification sound to accept the upper limit corresponding to the age.

3. An electronic device comprising:

a sound output circuit that outputs a sound;

a notification sound control circuit that controls a notification sound output by the sound output circuit; and a stop instruction accepting circuit that accepts a stop instruction of the notification sound; wherein the notification sound control circuit increases frequency of the notification sound in phases as time elapses when the notification sound is output by the sound output circuit, and stops the notification sound output by the sound output circuit when the instruction is accepted by the stop instruction accepting circuit, and the notification sound control circuit changes duration of a notification sound corresponding to the frequency each time the frequency of the notification sound increases in phases.

4. The electronic device according to claim 3, wherein the notification sound control circuit shortens the duration of the notification sound corresponding to the frequency each time the frequency of the notification sound increases in phases.

5. The electronic device according to claim 3, wherein the notification sound control circuit lengthens the duration of the notification sound corresponding to the frequency each time the frequency of the notification sound increases in phases.

6. An electronic device comprising:

a sound output circuit that outputs a sound;

a notification sound control circuit that controls a notification sound output by the sound output circuit; and a stop instruction accepting circuit that accepts a stop instruction of the notification sound; wherein the notification sound control circuit increases frequency of the notification sound in phases as time elapses when the notification sound is output by the sound output circuit, and stops the notification sound output by the sound output circuit when the instruction is accepted by the stop instruction accepting circuit, and the notification sound control circuit changes an increment amount of the frequency each time the frequency of the notification sound increases in phases.

7. The electronic device according to claim 6, wherein the notification sound control circuit increases the increment amount of the frequency each time the frequency of the notification sound increases in phases.

8. The electronic device according to claim 6, wherein the notification sound control circuit decreases the increment amount of the frequency each time the frequency of the notification sound increases in phases.

9. A non-transitory computer-readable recording medium storing a notification sound output program executed by an electronic device with a sound output circuit that outputs a sound, the notification sound output program causing the electronic device to:

control a notification sound output by the sound output circuit;

accept an upper limit specification of the frequency of the notification sound;

accept a stop instruction of the notification sound; and execute steps of increasing frequency of the notification sound in phases as time elapses when the notification sound is output by the sound output circuit, and stopping the notification sound output by the sound output circuit when the electronic device accepts a stop instruction; and increasing the frequency of the notification sound to the accepted upper limit in phases as time elapses when the notification sound is output by the sound output circuit.

* * * * *